United States Patent [19]

Ohyama et al.

[11] 4,034,841

[45] July 12, 1977

[54] PRINT WIRE ACTUATING DEVICE FOR A DOT MATRIX PRINTER

[75] Inventors: Sigeru Ohyama; Aisuke Sekikawa, both of Tokyo, Japan

[73] Assignee: Nippon Electric Co., Ltd., Tokyo, Japan

[21] Appl. No.: 624,426

[22] Filed: Oct. 21, 1975

[30] Foreign Application Priority Data

Oct. 23, 1974 Japan ..... 49-122097
Feb. 12, 1975 Japan ..... 50-18331

[51] Int. Cl.[2] ..... H01F 7/08

[52] U.S. Cl. ..... 197/1 R; 335/258; 335/274

[58] Field of Search ..... 197/1 R; 101/93.04, 101/93.05; 335/251, 255, 257, 258, 274, 192, 193

[56] References Cited

U.S. PATENT DOCUMENTS

| | | | |
|---|---|---|---|
| 2,417,438 | 3/1947 | O'Brien et al. | 335/257 X |
| 3,690,431 | 9/1972 | Howard | 197/1 R |
| 3,729,079 | 4/1973 | Zenner et al. | 197/1 R |
| 3,775,714 | 11/1973 | Heuer | 197/1 R X |
| 3,787,791 | 1/1974 | Borger et al. | 197/1 R X |
| 3,831,729 | 8/1974 | Howard | 197/1 R |
| 3,883,839 | 5/1975 | Barrett et al. | 335/255 X |
| 3,900,094 | 8/1975 | Larsen et al. | 197/1 R |
| 3,940,726 | 2/1976 | Gershnow | 335/274 |

*Primary Examiner*—Ralph T. Rader
*Attorney, Agent, or Firm*—Sughrue, Rothwell, Mion, Zinn & Macpeak

[57] ABSTRACT

A print wire solenoid device including a disc type plunger-restoring spring which consists of a continuous annular peripheral portion and spoke portions extending radially inwardly therefrom jointly to define a central opening for fitting engagement with the plunger. The plunger and the stationary core or stem members defining a solenoid gap, therebetween are both conically formed to minimize leakage of magnetic flux, thereby substantially increasing the effective flux density and hence the force of attraction. The disc spring, which is neither fixedly secured at any point to the plunger nor to the other adjacent components, is free from any stress concentration in operation and thus not only enables high speed printing operation with an increased length of stroke but facilitates fabrication of the device in combination with the conical formation of the plunger and stem members, which facilitates reduction in size and weight of the devices as well as in power consumption.

5 Claims, 4 Drawing Figures

FIG. 1.
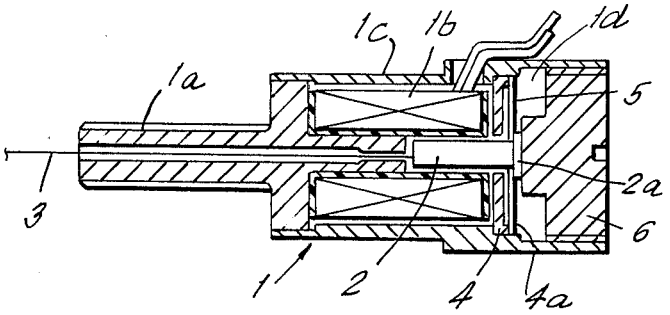
FIG. 2.
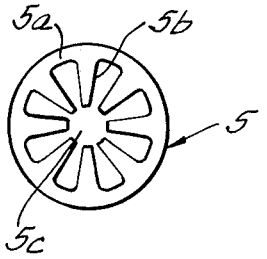
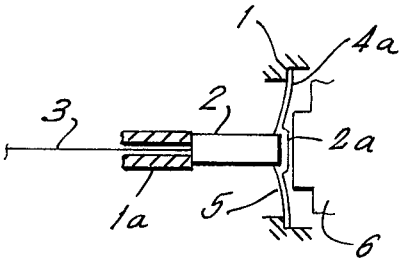
FIG. 3.
FIG. 4.
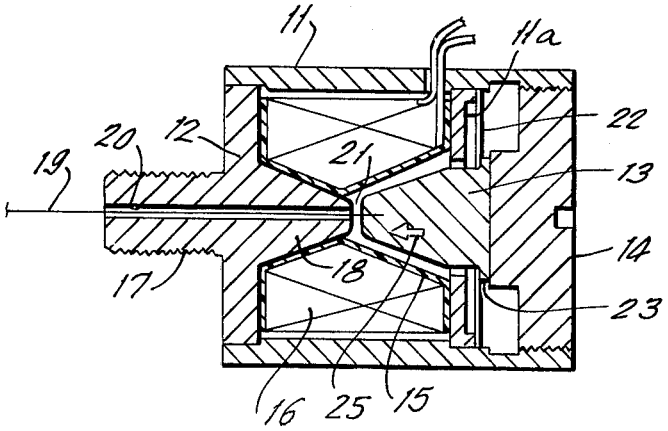

PRINT WIRE ACTUATING DEVICE FOR A DOT MATRIX PRINTER

BACKGROUND OF THE INVENTION

This invention relates to print wire actuating devices for the print head assembly of dot matrix type printers.

Generally, in the print head assemblyof assembly of type of printer, plunger type solenoids are employed, one for each of print wires, as means for selectively impacting one or more of print wires against a paper document or other recording medium. As is well known, with such print wire actuating devices, spring means are indispensable to serve the purpose of restoring the plunger each time the solenoid is deenergized and, in practice, use has been made of different forms of restoring spring, including springs of coiled form employed with printers of relatively low speed of operation and disc type springs employed with high-speed printers and including a central portion fixedly secured to the plunger and a cross or star-like formation of spoke portions extending radially outwardly from the central portion.

Use of a coiled spring in a print wire actuating solenoid as plunger-restoring means has been disadvantageous in that it necessitates a more or less increase in dimensions of the plunger and particularly in axial length thereof and results in a considerable increase in bulk and weight of the plunger unit, rendering the device practically impossible to operate at any high speed desired.

On the other hand, disc type springs of conventional design employed for high speed printing operation have involved various disadvantages, as described below. First, the configuration and the fixed, mounting of this type of restoring spring set a certain limit to the stress allowable in the spring material, precluding any increase in length of stroke of the plunger. Further, the fixed mounting of the spring on the plunger not only makes the fabrication process complicated, causing increase in initial cost, but also gives only a limited reliability, involving the danger of the spring being dislodged during operation.

In addition, with conventional forms of plunger type solenoids employed as print wire actuating means, any design aimed at reducing the size and weight of the solenoid device, which includes a plunger, normally cylindrical in shape, has caused reduction in plunger face area and hence in force of attraction, making it difficult to obtain a driving energy large enough for the plunger to operate with a high responsivity, and thus reduction in size and weight of the solenoid device has been definitely limited. Moreover, with previous forms of solenoid assembly, the plunger has usually been guided for axial movement by means of the coil spool and thus subjected to a substantial frictional drag. Owing to this, the plunger has been liable to be worn down rather rapidly in high speed operation and it has been difficult to maintain the stability in operation of the device or to lengthen the service life thereof.

SUMMARY OF THE INVENTION

In view of the different problems previously encountered with conventional forms of print wire actuating devices as described above, the present invention is intended to realize a dot matrix type printer having an increased range of use and has for its object the provision of a print wire actuating device which is capable of high speed operation with an increased length of stroke of the print wire. To attain this objective, the present invention proposes to employ as plunger-restoring spring means a circular disc-like spring of a particular configuration consisting of a continuous annular peripheral portion bearing against an annular shoulder surface provided within the device and a plurality of radially aligned spoke portions projecting radially inwardly from the inner peripheral edge of said annular peripheral portion with the respective inner end edges aligned jointly to define a central opening for fitting engagement with the plunger along a radially outwardly extending annular flange formed on the outer periphery thereof. In this manner, the disc-like spring member can be mounted accurately in the device without being fixed to the plunger in any manner and there occurs no stress concentration in the spring material, all the stresses to which the spring member is subjected in operation being distributed in the material in an effective manner.

Another object of the present invention is to provide a print wire actuating device of the character described which is of a compact and lightweight structure designed to enable the device to operate at high speed with low power consumption and with high reliability and responsivity for an extended length of service life.

To this end, the device of the present invention includes, among others, a stationary stem member of magnetic material which forms part of the solenoid casing and is formed with an axially aligned opening for passage of the print wire therethrough and a print wire carrying plunger member resiliently supported by spring means in axially aligned relation with said stem member and normally biased by said spring means against a stationary stop formed on the solenoid casing, said members having respective conical end formations tapering toward each other and positioned in aligned opposite relation to teach other. With this arrangement, there are obtained various great advantages over prior art actuating devices of the same kind owing to the fact that the conical formations on the stem and plunger members effectively minimize the amount of leakage of magnetic flux, thereby maximizing the effective magnetic flux density in the air gap between the two members, and that the plunger in operation never makes contact with the solenoid yoke or casing including the stem member nor with the coil spool and thus can operate at high speeds with increased responsivity and for an extended period of service life.

These and other objects, features and advantages of the present invention will become apparent from the following description when taken in conjunction with the accompanying drawing.

BRIEF DESCRIPTION OF THE DRAWING

The accompanying drawing illustrates a few preferred embodiments of the present invention.

In the drawing:

FIG. 1 is an axial cross-sectional side view of one preferred embodiment of the invention;

FIG. 2 is an end view of the plunger-restoring disc spring shown in FIG. 1;

FIG. 3 is a fragmentary side view illustrating the manner in which the plunger shown in FIG. 1 operates upon impression of a printing pulse on the solenoid coil; and FIG. 4 is a view similar to FIG. 1 illustrating another embodiment of the present invention.

DESCRIPTION OF THE PREFERRED EMBODIMENTS

Referring to FIG. 1, which illustrates the whole structure of an actuating device embodying the present invention, reference numeral 1 generally indicates a coil assembly including a mounting core or stem member 1a, a solenoid coil 1b and a tubular casing body 1c. Reference numeral 2 indicates a plunger inserted in the coil assembly 1 in axially aligned relation therewith and carrying a print wire 3, which is fixed at its rear or right-hand end to the front end of the plunger 2 in axially aligned relation therewith. The coil assembly 1 has a rearwardly open hollow cylindrical space 1d defined in the rear portion of the casing 1c and in which space a ring core 4 and a plunger-restoring disc spring member 5 are incorporated with a combined stop and end closure member 6 threadedly engaged in the casing 1c at the rear end thereof. As illustrated, the rear end face of a ring core 4 is raised along the outer periphery thereof as indicated at 4a to form a rearwardly facing annular shoulder adjacent to the inner peripheral wall surface of the casing 1c.

As illustrated in FIG. 2, the disc spring member 5 consists of a continuous annular peripheral portion 5a and a plurality of mutually independent, radially aligned spoke portions 5b extending radially inwardly from the inner peripheral edge thereof.

The spoke portions 5b are each tapered toward their inner free ends and their inner end edges are aligned to cooperatively define a central opening 5c in the disc spring 5 for fitting engagement with the outer peripheral surface of the plunger 2. The peripheral portion 5a of the disc spring 5 has its left-hand surface bearing against the rearwardly facing annular shoulder surface 4a formed on the ring core 4, as shown in FIG. 1.

The plunger 2 is formed at the rear end thereof with an annular flange 2a extending radially outward. The plunger 2 is inserted axially forwardly into the cylindrical space 1d for fitting engagement with the central opening 5c in the disc spring 5 until the front or left-hand surface of the annular flange 2a is brought into abutting engagement with the tip portions of the respective spokes 5b of the disc spring 5. The disc spring 5 is preloaded to a definite extent by threading the stop member 6 into a predetermined axial position against the resiliency of the disc spring 5. The disc spring 5 being thus preloaded acts to hold the rear end face of the plunger 2 in pressure engagement with the front end face of the stop member 6 and thus, in cooperation with the latter member, resiliently supports the plunger 2 in a predetermined axially aligned position within the coil assembly 1 and in non-contacting relation therewith.

In operation of the device described above, whenever a printing pulse is applied to the solenoid coil 1b, the plunger 2 is attracted forwardly against the resiliency of the disc spring 5, as shown in FIG. 3, and the print wire 3, being carried on the plunger 2, is driven axially forwardly to print a dot on the surface of a paper document or like recording medium, Subsequently, upon termination of the printing pulse, the plunger 2 and print wire 3 are restored to their initial, rest position under the action of the disc spring 5. With repetition of such printing operation, the disc spring 5 is of course repeatedly forced to flex axially forwardly. It is to be noted at this point, however, that the disc spring 5 is characteristically free for elastic deformation without any stress concentration therein since it is not fixedly connected at any point with the adjacent component but is only held in bearing relation against the adjacent components along its annular peripheral portion 5a and the periphery of central opening 5c for free flexing movement, as will readily be recognized from the description made hereinbefore. The configuration and arrangement of the plunger-restoring spring is highly advantageous in that it facilitates realization of a print wire actuating device which is compact and particularly adapted for high speed printing operation with an increased length of stroke, as contemplated in the present invention, and also reduces cost of fabrication of such actuating device while increasing its reliability as there is no need to secure the disc spring to the plunger 5 and the plunger can be readily assembled into the device simply by insertion into the disc spring 5 from the rear end thereof.

Description will next be made with reference to FIG. 4, which illustrates the whole structure of another embodiment of the present invention.

As with the case of the embodiment previously described, the device shown in FIG. 4 includes a solenoid yoke or casing 11 which is generally cylindrical in shape. A core or stem member 12 of magnetic material is fixedly fitted in the casing at one end thereof and a closure member 14 is fixedly threaded in the casing at the other end thereof to serve as back stop means for a plunger 13. A solenoid coil 16 is wound on a spool 15 which is fixed to the stem member 12 and arranged between the stem member 12 and an annular yoke portion 11a extending radially inwardly from the hollow cylindrical body portion of yoke 11.

The core or stem member 12 has a threaded portion 17 projecting from the front or left-hand surface thereof for threadedly engaging a tapped hole provided in the print head assembly, not shown, the stem member 12 is formed on the inside with an inwardly tapering truncated conical projection 18 and has an axial opening 20 for passage therethrough of a print wire 19, which is secured to the front end of the plunger 13 in axially aligned relation therewith.

As shown, the plunger 13 is generally of a truncated conical shape, tapering forwardly, and is preferably resiliently supported by spring means 22 of basically the same structure as that shown in FIG. 2 so as to be maintained in alignment with the stationary stem member 12. The plunger 13 has a rear end surface normally bearing against the front end face of stop member 14 under the bias of the spring means 22 with the front end face of the plunger 13 held opposite to the rear extremity of the tapered projection 18 formed in stationary stem member 12, defining therebetween a predetermined axial space or gap 21. As illustrated, there is provided around the plunger 13 a clearance space which allows the conical shaped plunger 13 to move axially at least over its length of stroke without any interference with the surrounding components including the coil spool 15 and the annular yoke portion 11a.

In this embodiment, spring means 22 employed to support the plunger 13 takes the form of a circular disc spring having a circular central opening therein to receive the plunger 13 and fitted in the casing or yoke 11 with the peripheral edge portion of the disc spring 22 bearing against the annular shoulder formed on the rear surface of the yoke portion 11a around the outer periphery thereof. The plunger 13 is formed at the rear end with a radially outwardly extending annular flange 23 so as to be normally biased by the disc spring 22 against the stationary stop member 14 through the medium of the annular flange 23, as illustrated.

In assembling the device, the plunger 13 is fitted into the central opening in the disc spring 22 from behind thereof and is then advance an appropriate distance axially forwardly against the bias of the disc spring 22 by the stop member 14, which is threaded in the rear end portion of the casing body 11. In this manner, the disc spring 22 is preloaded to a definite extent while at the same time a predetermined amount of solenoid gap or axial spacing 21 between the plunger 13 and stem member 12 is obtained. The stop member 14 thus threaded in the casing body 11 to an appropriate extent is firmly secured thereto, for example, by means of an adhesive agent.

In operation, when a signal representing a selected pattern of a character or symbol is applied to a solenoid driver circuit (not shown) and the solenoid coil 16 is energized by a corresponding current pulse, a magnetic flux is generated in the gap 21 so that the plunger 13 is attracted to move axially forwardly, as indicated by the arrow 25, so that the print wire 19 is impacted at the front extremity thereof against a paper document or other recording medium to print a dot thereon. After such printing operation, the plunger 13 immediately returns to its normal position illustrated under the restoring action of disc spring 22.

With this second embodiment of the invention, it will readily be appreciated that leakage of the magnetic flux flowing through the stem member 12 and plunger 13 is much reduced owing to the conical formation of the two components and the amount of effective magnetic flux in the solenoid gap 21 is increased to give rise to an extraordinarily large force of magnetic attraction. Such advantageous effect of the conical formation of the stem and plunger members of the solenoid may be further enhanced by chamfering or rounding the peripheral edges of the adjacent ends of the conical members, as illustrated.

It will be apparent from the foregoing description that, according to the present invention, the increase in the force of attraction due to the configuration of the stem and plunger members, in combination with the resilient support of the plunger by spring means, enables the plunger to operate with high responsivity rectilinearly without any interference or frictional contact with the coil spool or the yoke structure, thus involving no irregularities in operation as may otherwise result from friction or other like disturbances. In this manner, the device according to the present invention can operate with increased stability for an extended period of service life. In addition, the increased force of attraction enables a reduction in size and weight of the device and also in electric power consumption, and the device is particularly easy to fabricate and readily adjustable owing to its peculiar structure.

Although only two preferred embodiments have been shown and described, it will be apparent to those skilled in the art that many changes and modifications may be made therein without departing from the spirit of the invention or from the scope of the appended claims.

What is claimed is:

1. In a print wire actuating device for a dot matrix type printer, of the type which includes a solenoid assembly comprising a plunger type solenoid armature having a print wire fixed to the front end thereof in aligned relation therewith and a disc-like spring member supporting said solenoid armature and normally biasing said solenoid armature rearwardly into abutting engagement with stop means formed in the rear portion of said solenoid assembly, the improvement comprising: a rearwardly facing annular shoulder formed in said solenoid assembly and a radially outwardly extending annular flange formed on the periphery of said solenoid armature, said disc-like spring member comprising single circular disc having a continuous annular peripheral portion bearing against said rearwardly facing annular shoulder and having a plurality of mutually independent spoke portions extending radially inwardly from the annular peripheral portion, said spoke portions having inner end edges aligned to cooperatively define a central opening for fitting engagement with the flange of said solenoid armature but not fixed thereto.

2. A print wire actuating device as set forth in claim 1, in which said solenoid armature has a forwardly tapered truncated conical front end portion and said solenoid assembly further comprises a stationary stem member formed with an axially aligned opening for passage of the print wire therethrough and having a rearwardly tapered truncated conical projection formed on the rear side thereof and positioned in aligned opposing relation to said conical front end portion of said solenoid armature.

3. In a print wire actuating device for a dot matrix type printer, of the type which includes a solenoid assembly comprising a plunger type solenoid armature having a print wire fixed to the front end thereof in aligned relation therewith and a disc-like spring member supporting said solenoid armature and normally biasing said solenoid armature rearwardly into abutting engagement with stop means formed in the rear portion of said solenoid assembly, the improvement comprising: a rearwardly facing annular shoulder formed in said solenoid assembly; a radially outwardly extending annular flange formed on the periphery of said solenoid armature, said disc-like spring member comprising a single circular disc having a continuous annular peripheral outer portion bearing against said rearwardly facing annular shoulder and having an inner portion engaging the flange of said solenoid armature but not fixed thereto;

said solenoid armature having a forwardly tapered truncated conical front end portion and said solenoid assembly further comprising a stationary stem member formed with an axially aligned opening for passage of the print wire therethrough and having a rearwardly tapered truncated conical projection formed on the rear side thereof and positioned in aligned opposing relation to said conical front end portion of said solenoid armature.

4. The device of claim 3 including a space between the adjacent opposed tapered ends said space being a distance greater than the throw of said print wire whereby the print wire impacts a paper document and returns towards the rest position under control of the spring without the adjacent tapered ends coming into engagement.

5. The device of claim 4 further comprising a solenoid having a hollow interior axially aligned with the print wire, at least the rear portion of the hollow interior having a taper conforming to that of the armature to permit unimpeded movement of the armature extending into the opening in the rear portion of said solenoid.

* * * * *